US008960829B2

(12) United States Patent
Iwata

(10) Patent No.: US 8,960,829 B2
(45) **Date of Patent: *Feb. 24, 2015**

(54) PRINTING APPARATUS AND METHOD OF CIRCULATING WHITE INK

(71) Applicant: Seiko Epson Corporation, Tokyo (JP)

(72) Inventor: Yuji Iwata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/663,800

(22) Filed: Oct. 30, 2012

(65) Prior Publication Data

US 2013/0113854 A1 May 9, 2013

(30) Foreign Application Priority Data

Nov. 7, 2011 (JP) ..... 2011-243729

(51) Int. Cl.
*B41J 29/38* (2006.01)
*B41J 2/21* (2006.01)
*B41J 2/175* (2006.01)

(52) U.S. Cl.
CPC *B41J 2/175* (2013.01); *B41J 29/38* (2013.01); *B41J 2/2117* (2013.01)
USPC ..... 347/6

(58) Field of Classification Search
CPC ..... B41J 2/125; B41J 2/175; B41J 2/17509; B41J 2/17513; B41J 2/1752; B41J 2/17553; B41J 2/17596; B41J 2/18; B41J 2202/20
USPC ..... 347/6, 9, 14, 19, 84–86, 95, 96
See application file for complete search history.

(56) References Cited

U.S. PATENT DOCUMENTS

| | | | | |
|---|---|---|---|---|
| 4,607,261 | A | 8/1986 | McCann et al. | |
| 4,680,696 | A | 7/1987 | Ebinuma et al. | |
| 6,000,792 | A | 12/1999 | Koizumi et al. | |
| 6,039,442 | A | 3/2000 | Hagiwara et al. | |
| 2007/0291086 | A1 * | 12/2007 | Murakami et al. | 347/85 |
| 2009/0009541 | A1 | 1/2009 | Shimazaki | |
| 2009/0167826 | A1 | 7/2009 | Ishizawa et al. | |
| 2009/0201347 | A1 * | 8/2009 | Hamano | 347/85 |

(Continued)

FOREIGN PATENT DOCUMENTS

| | | |
|---|---|---|
| EP | 2305475 | 4/2011 |
| GB | 2447919 | 10/2008 |

(Continued)

*Primary Examiner* — Manish S Shah
*Assistant Examiner* — Roger W Pisha, II
(74) *Attorney, Agent, or Firm* — Workman Nydegger

(57) ABSTRACT

A printing apparatus includes a transporting unit which transports a medium, a head unit which discharges a plurality of types of ink onto the medium, a storage unit which stores white ink of the plurality of types of ink, a plurality of supply flow paths for supplying the white ink from the storage unit to the head unit, a plurality of bypass flow paths which are bridged between different supply flow paths from each other, and a controller which repeatedly performs a transport operation by the transporting unit, a color print operation and a white print operation to perform an image forming process on the medium and circulates the white ink in a circulation flow path formed only of the supply flow paths and the bypass flow paths among the storage unit, the head unit, the supply flow paths and the bypass flow paths, during the color print operation.

5 Claims, 10 Drawing Sheets

(56) References Cited

U.S. PATENT DOCUMENTS

| | | | | |
|---|---|---|---|---|
| 2009/0231368 | A1 | 9/2009 | Nakano et al. | |
| 2009/0303283 | A1 | 12/2009 | Nakano et al. | |
| 2009/0315927 | A1* | 12/2009 | Uehara | 347/7 |
| 2010/0079511 | A1 | 4/2010 | Murakami et al. | |
| 2010/0085396 | A1 | 4/2010 | Yokota et al. | |
| 2010/0283808 | A1 | 11/2010 | Terakado et al. | |
| 2011/0115844 | A1* | 5/2011 | Ozawa | 347/28 |
| 2011/0267406 | A1 | 11/2011 | Hanson | |

FOREIGN PATENT DOCUMENTS

| | | |
|---|---|---|
| JP | 60-137655 | 7/1985 |
| JP | 3106013 | 3/1994 |
| JP | 2011-110853 | 6/2011 |

* cited by examiner

PRINTING APPARATUS AND METHOD OF CIRCULATING WHITE INK

CROSS REFERENCES TO RELATED APPLICATIONS

This application claims the benefit of Japanese Patent Application No. 2011-243729, filed on Nov. 7, 2011, which is hereby incorporated by reference herein in its entirety.

BACKGROUND

1. Technical Field

The present invention relates to a printing apparatus and a method of circulating white ink.

2. Related Art

Hitherto, there has been widely known a printing apparatus including a transporting unit which transports a medium, a head unit which discharges plural types of ink onto the medium, a storage unit which stores white ink of the plural types of ink and plural flow paths for supplying the white ink from the storage unit to the head unit. As the printing apparatus, for example, an ink jet printer which discharges ink onto various mediums such as paper or a film and performs printing may be exemplified.

Japanese patent No. 3,106,013 is an example of related art.

However, the white ink is accumulated in the flow paths for supplying the white ink from the storage unit to the head unit and a defect that the components of the white ink are settled occurs in some cases. The phenomenon causes quality deterioration of an image.

SUMMARY

An advantage of some aspects of the invention is that it provides a printing apparatus and a method of circulating white ink that appropriately suppress quality deterioration of an image.

According to an aspect of the invention, there is provided a printing apparatus including a transporting unit which transports a medium, a head unit which discharges a plurality of types of ink onto the medium, a storage unit which stores white ink of the plurality of types of ink, a plurality of supply flow paths for supplying the white ink from the storage unit to the head unit, a plurality of bypass flow paths which are bridged between different supply flow paths from each other, and a controller which repeatedly performs a transport operation in which the transporting unit is controlled to transport the medium, a color print operation in which ink for color printing of the plurality of types of ink is discharged from the head unit to perform color printing and a white print operation in which the white ink is discharged from the head unit to perform white printing so that an image forming process which forms an image on the medium is performed and circulates the white ink in a circulation flow path which is formed only of the supply flow paths and the bypass flow paths among the storage unit, the head unit, the supply flow paths and the bypass flow paths, when the color print operation is performed.

Other characteristics of the invention will be apparent from the matters set forth in the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
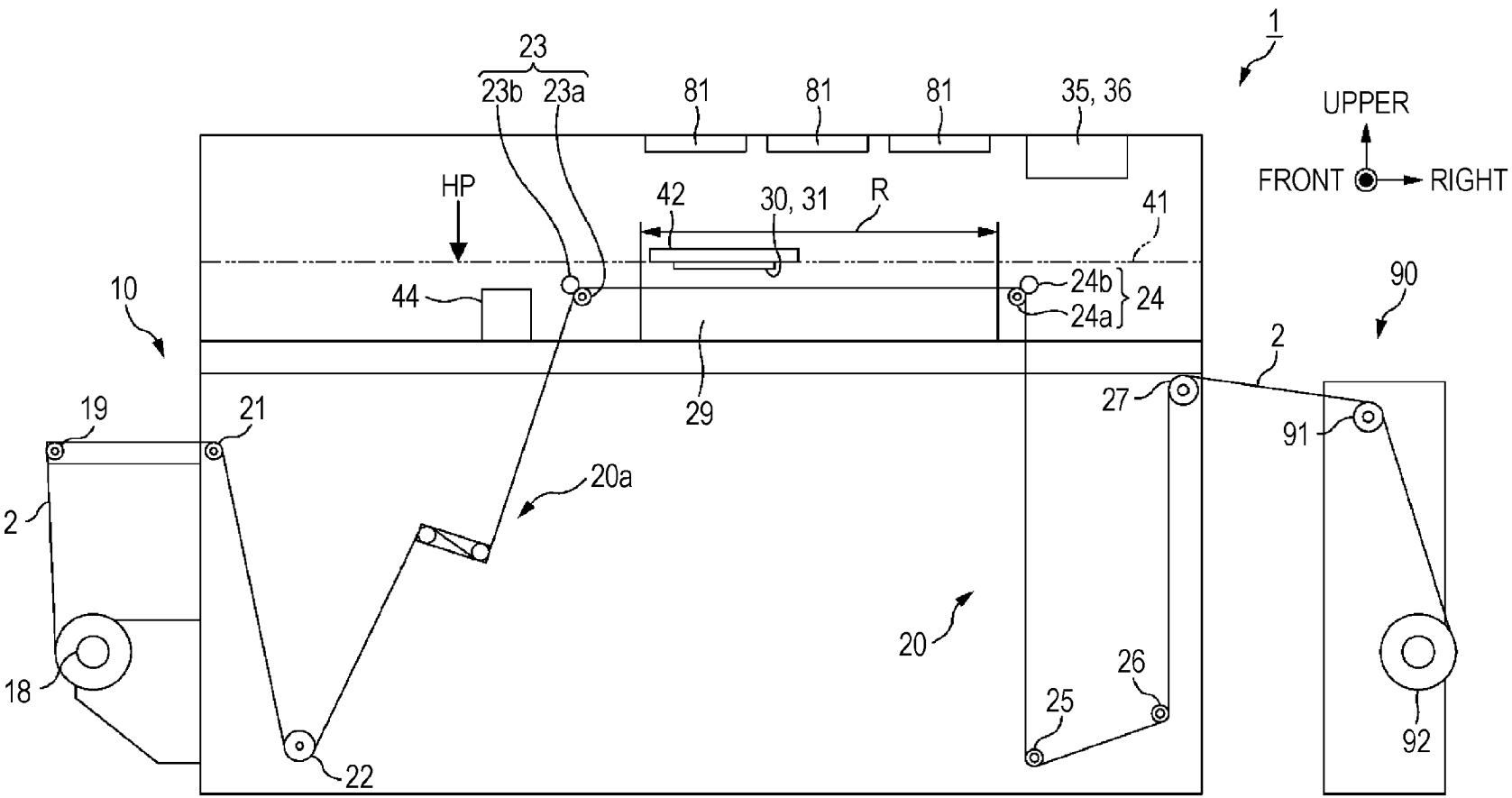
FIG. 1 is a schematic view showing a configuration of an image recording apparatus.

At least the following will be apparent from the matters set forth in the specification and the accompanying drawings.

A printing apparatus includes a transporting unit which transports a medium, a head unit which discharges a plurality of types of ink onto the medium, a storage unit which stores white ink of the plurality of types of ink, a plurality of supply flow paths for supplying the white ink from the storage unit to the head unit, a plurality of bypass flow paths which are bridged between different supply flow paths from each other, and a controller which repeatedly performs a transport operation in which the transporting unit is controlled to transport the medium, a color print operation in which ink for color printing of the plurality of types of ink is discharged from the head unit to perform color printing and a white print operation in which the white ink is discharged from the head unit to perform white printing so that an image forming process which forms an image on the medium is performed and circulates the white ink in a circulation flow path which is formed only of the supply flow paths and the bypass flow paths among the storage unit, the head unit, the supply flow paths and the bypass flow paths, when the color print operation is performed.

According to the printing apparatus, it is possible to appropriately suppress quality deterioration of an image.

Furthermore, the controller may repeatedly perform a series of operations performed in order of the white print operation, the color print operation and the transport operation to perform the image forming process so that a circulation process to circulate the white ink in the circulation flow path ends before the transport operation is started.

In this case, the white print operation is reliably performed with the statically determinated white ink.

In addition, the head unit may be made up of a plurality of sub-head units, each of the plurality of supply flow paths supplies the white ink to each of the corresponding sub-head units, and the controller may determine whether there is the white print operation in which some of the plurality of sub-head units do not discharge the white ink and then, determine whether the white ink is circulated in the circulation flow path on the basis of the determination result.

In this case, since the ink circulation process is performed only when necessary, it is possible to realize an effective process.

Moreover, the printing apparatus may further include a platen which supports and heats the medium and the head unit may discharge the white ink onto the heated medium which is supported by the platen.

In this case, an effect of appropriately suppressing quality deterioration of an image can be more effectively exhibited.

Next, a method of circulating white ink includes repeatedly performing a transport operation in which a transporting unit which transports a medium is controlled to transport the medium, a color print operation in which ink for color printing is discharged from a head unit which discharges a plurality of types of ink onto the medium to perform color printing and a white print operation in which white ink is discharged from the head unit to perform white printing so that an image forming process which forms an image on the medium is performed and circulating the white ink in a circulation flow path which is formed only of supply flow paths and bypass flow paths among a storage unit which stores the white ink, the head unit, a plurality of the supply flow paths which supply the white ink to the head unit from the storage unit and a plurality of the bypass flow paths which are bridged between different supply flow paths from each other, when the color print operation is performed.

According to the method of circulating white ink, it is possible to appropriately suppress quality deterioration of an image.

Configuration Example of Image Recording Apparatus 1

Figure 2:
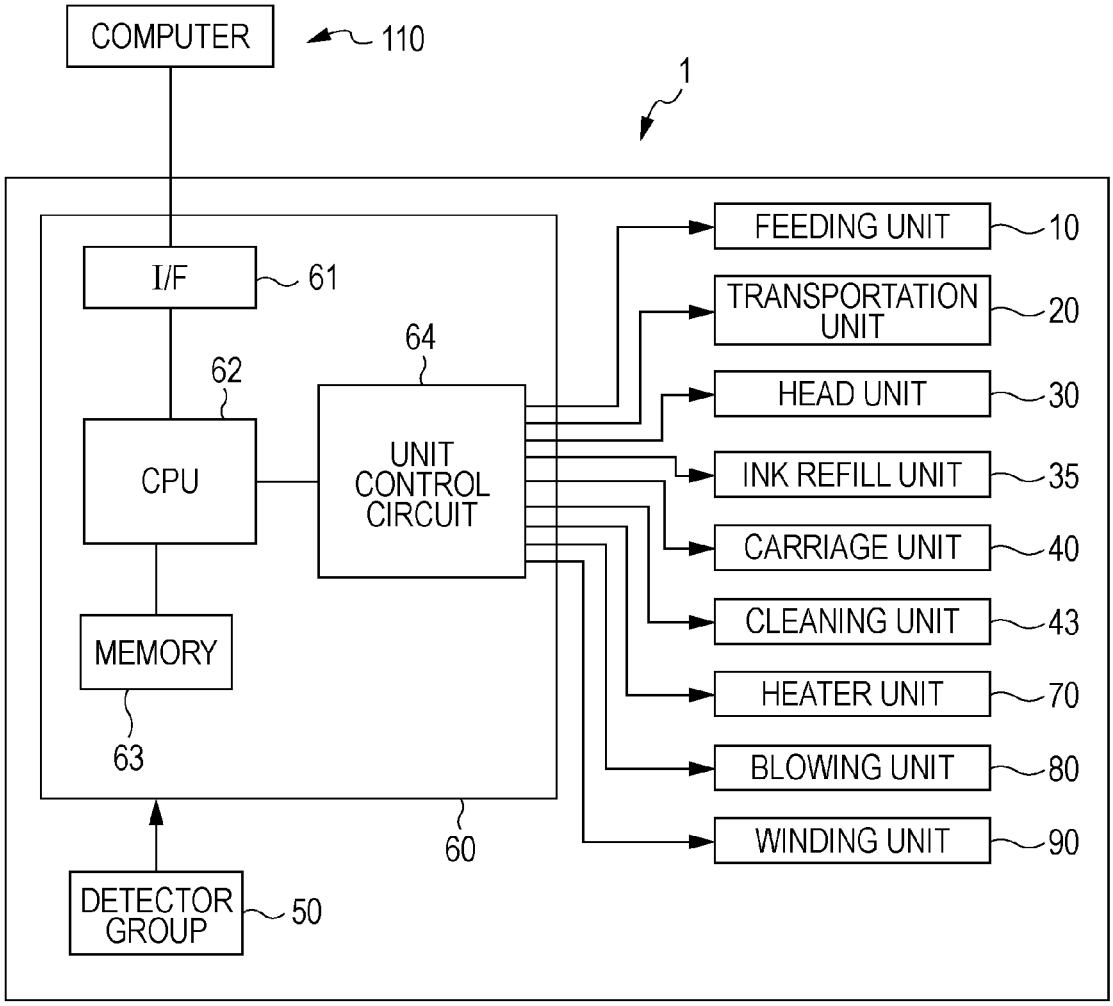
FIG. 2 is a block diagram showing a configuration of the image recording apparatus.

As an example of a printing apparatus, a configuration example of an image recording apparatus 1 (an ink jet printer in the embodiment) will be described using FIGS. 1 and 2. FIG. 1 is a schematic cross-sectional view of the image recording apparatus 1. FIG. 2 is a block diagram of the image recording apparatus 1.

Further, in the following description, cases where "upper and lower direction" and "left and right direction" are used make reference to directions indicated by arrows of FIG. 1. In addition, a case where "front and back direction" is used refers to a direction intersecting a paper plane in FIG. 1.

In the embodiment, as a medium example of the image recording apparatus 1 to record an image, paper which is wound in a roll shape (hereinafter, referred to as rolled paper (continuous paper)) is used for the description.

The image recording apparatus 1 according to the embodiment includes a transport unit 20 as an example of a transporting unit and a feeding unit 10, a platen 29 and a winding unit 90 along a transport path in which the transport unit 20 transports the rolled paper 2 (the transport path is indicated by a portion in which the rolled paper 2 is positioned between a winding shaft 18 and a winding drive shaft 92 in FIG. 1) and further includes a head unit 30 which discharges plural types of ink to perform image recording in an image recording region R on the transport path, an ink refill unit 35, a carriage unit 40, a cleaning unit 43, a heater unit 70, a blowing unit 80 which blows air to the rolled paper 2 on the platen 29, a controller 60 which controls the units to perform operation so as to function as the image recording apparatus 1 and a detector group 50, as shown in FIGS. 1 and 2.

The feeding unit 10 is a unit which feeds the rolled paper 2 to the transport unit 20. The feeding unit 10 has the winding shaft 18 around which the rolled paper 2 is wound and that is rotatably supported and a relay roller 19 around which the rolled paper 2 delivered from the winding shaft 18 is drawn and guided to the transport unit 20.

The transport unit 20 is a unit which transports the rolled paper 2 fed from the feeding unit 10 along a predetermined transport path. The transport unit 20 has a relay roller 21 which is positioned horizontally rightward with respect to the relay roller 19, a relay roller 22 which is positioned rightward and diagonally downward as seen from the relay roller 21, a first transporting roller 23 which is positioned rightward and diagonally upward as seen from the relay roller 22 (upstream side of a transportation direction as seen from the platen 29), a steering unit 20*a* which is positioned between the relay roller 22 and the first transporting roller 23, a second transporting roller 24 which is positioned rightward as seen from the first transporting roller 23 (downstream side of transportation direction as seen from the platen 29), a reversing roller 25 which is positioned vertically downward as seen from the second transporting roller 24, a relay roller 26 which is positioned rightward as seen from the reversing roller 25 and a delivery roller 27 which is positioned upward as seen from the relay roller 26, as shown in FIG. 1.

The relay roller 21 is a roller around which the rolled paper 2 sent from the relay roller 19 is drawn from the left side and directed downward while being imparted with slack.

The relay roller 22 is a roller around which the rolled paper 2 sent from the relay roller 21 is drawn from the left side and transported rightward and diagonally upward.

The first transporting roller 23 has a first driving roller 23*a* which is driven by a motor (not shown) and a first driven roller 23*b* arranged so as to face the first driving roller 23*a* with interposing of the rolled paper 2 therebetween. The first transporting roller 23 is a roller adapted to pull upward the rolled paper 2 to which slack towards the downward side is imparted, and to transport the rolled paper to the image recording region R to face the platen 29. During a period in which image printing is performed on a portion of the rolled paper 2 on the image recording region R, the first transporting roller 23 temporarily stops transporting. Through drive control by the controller 60, the transportation amount of the rolled paper 2 positioned on the platen 29 is adjusted through rotation of the first driven roller 23*b* in association with rotation driving of the first driving roller 23*a*.

As described above, the transport unit 20 has a mechanism to transport the rolled paper 2 while imparting downward slack to a portion of the rolled paper which is drawn between the relay rollers 21 and 22 and the first transporting roller 23. This slack imparted to the rolled paper 2 is monitored by the controller 60 on the basis of a detection signal from a sensor for slack detection (not shown). Specifically, in a case where the sensor for slack detection detects a portion of the rolled paper 2 imparted with slack between the relay rollers 21 and 22 and the first transporting roller 23, since tension of appropriate magnitude is imparted to the portion, it is possible for the transport unit 20 to transport the rolled paper 2 in a slack state. On the other hand, when the sensor for slack detection does not detect a portion of the rolled paper 2 imparted with slack, since tension of excessive magnitude is imparted to the portion, the transport unit 20 temporarily stops transporting of the rolled paper 2 and adjusts the tension to the appropriate magnitude.

As shown in FIG. 1, the steering unit 20*a* is positioned on the transport path in an inclined state and is a unit to be changed in a width direction position of the rolled paper 2 (a position in which the rolled paper 2 is positioned in the width direction (front and back direction shown in FIG. 1)) through the rotation. In other words, when the rolled paper 2 is transported along the transport path, the width direction position of the rolled paper 2 is changed by the change of the tension which works on the rolled paper 2 due to a shaft misalignment or an assembly error of the relay rollers in some cases. Then, the steering unit 20*a* is a unit to adjust the width direction position of the rolled paper 2.

The second transporting roller 24 has a second driving roller 24*a* which is driven by a motor (not shown) and a second driven roller 24*b* arranged so as to face the second driving roller 24*a*, with interposing of the rolled paper 2 therebetween. The second transporting roller 24 is a roller that, after an image is recorded to the rolled paper 2 by the head unit 30, transports a portion thereof horizontally in the right direction along the support surface of the platen 29, and then subsequently transports the portion downward in the vertical direction. The transportation direction of the rolled paper 2 is thereby changed. Further, the second driven roller 24*b* rotates in association with rotation driving of the second driving roller 24*a* by drive control of the controller 60 so that adjustments are made to a predetermined tension to be imparted to the portion of the rolled paper 2 positioned on the platen 29.

The reversing roller 25 is a roller around which the rolled paper 2 sent from the second transporting roller 24 is drawn from the upward left side and transported rightward and diagonally upward.

The relay roller 26 is a roller around which the rolled paper 2 sent from the reversing roller 25 is drawn from the downward left side and transported upward.

The delivery roller 27 is configured such that the rolled paper 2 sent from the relay roller 26 is drawn thereabout from the downward left side and delivered to the winding unit 90.

The rolled paper 2 is sequentially moved through each roller in this manner so that a transport path for transporting the rolled paper 2 is formed. Further, the rolled paper 2 is intermittently transported along the transport path by the transport unit 20 in unit regions that correspond to the image recording region R.

The head unit 30 is a unit to record an image on the portion of the rolled paper 2 positioned the image recording region R on the transport path. In other words, the head unit 30 discharges ink onto the portion of the rolled paper 2 fed to the image recording region R (on the platen 29) on the transport path by the transport unit 20 to form an image. The head unit 30 has fifteen heads 31 in the embodiment.

Each head 31 has nozzle rows in which nozzles are arranged in a nozzle row direction on the bottom surface thereof. In the embodiment, the head 31 has nozzle rows which are respectively made up of plural nozzles #1 to #N for each of ink types (colors) such as yellow (Y), magenta (M), cyan (C), black (K) and white (W). The nozzles 41 to #N of each of the nozzle rows are linearly aligned along an intersection direction intersecting the transportation direction of the rolled paper 2 (that is, the intersection direction is the nozzle row direction described above). Each nozzle row is arranged parallel along the transportation direction with spaces therebetween.

Each nozzle #1 to #N is provided with a piezo element (not shown) as a driving element for the purpose of ejecting ink drops. When a voltage of a predetermined duration is applied between electrodes provided at both ends, the piezo element extends in accordance with the application time of voltage, causing the side wall of the ink flow path to deform. Due to this, the volume of the ink flow path contracts in accordance with expansion and contraction of the piezo element, and an amount of ink as much as the contraction is discharged as an ink drop from each nozzle #1 to #N of each color.

The fifteen heads 31 are aligned in the intersection direction (the nozzle row direction), thereby forming the head unit 30. Therefore, the head unit 30 has 15×N nozzles for each ink type (color).

The ink refill unit 35 is a unit to refill the head unit 30 with ink, when the amount of ink is reduced in the head unit 30 by discharging the ink from the head 31. Further, the ink refill unit 35 will be described in detail later.

The carriage unit 40 is a unit to move the head unit 30 (heads 31). The carriage unit 40 has a carriage guide rail 41 (indicated by double-dot and dash lines in FIG. 1) which extends in the transportation direction (left and right direction), a carriage 42 which is supported to reciprocate in the transportation direction (left and right direction) along the carriage guide rail 41 and a motor (not shown).

The carriage 42 is provided with the head unit 30, that is, fifteen heads 31. More specifically, the carriage 42 is divided into four sub-carriages (first sub-carriage to fourth sub-carriage) and four heads 31 are respectively provided in the first sub-carriage to a third sub-carriage and three heads 31 are provided in the fourth sub-carriage.

In other words, the fifteen heads 31 configures four head groups (corresponding to plural sub-head units), that is, a first head group 302 to which a first head to a fourth head belong, a second head group 304 to which a fifth head to an eighth head belong, a third head group 306 to which a ninth head to a twelfth head belong and a fourth head group 308 to which a thirteenth head to a fifteenth head belong. Then, the first head group 302 is provided in the first sub-carriage, the second head group 304 is provided in the second sub-carriage, the third head group 306 is provided in the third sub-carriage and the fourth head group 308 is provided in the fourth sub-carriage, respectively.

Further, the carriage 42 made up of the four sub-carriages is configured to be driven by the driving of the motor (not shown) and integrally formed with the head unit 30 (that is, fifteen heads 31) made up of the four head groups so as to move in the transportation direction (left and right direction).

The cleaning unit 43 (not shown in FIG. 1) is a unit to perform cleaning on the head 31. The cleaning unit 43 is provided at a home position (hereinafter, referred to as HP, refer to FIG. 1), and has a cap (not shown) and a suction pump 43*a* (refer to FIG. 4 and the like). When the head 31 (carriage 42) is moved in the transportation direction (left and right direction) and positioned at the HP, the cap (not shown) comes into close contact with the lower surface (nozzle surface) of the head 31. When the suction pump 43*a* is operated with the cap in a state of close contact in this manner, the ink in the head 31 is suctioned together with thickened ink and paper dust. Cleaning of the head is completed through recovery of clogged nozzles from a non-discharge state in this manner.

A flushing unit 44 is provided between the platen 29 and the HP in the transportation direction (left and right direction) and when the head 31 (carriage 42) is moved in the transportation direction (left and right direction) to be at a position to face the flushing unit 44, the head 31 performs flushing operation to perform flushing by discharging the ink from each nozzle which belongs to the nozzle row.

The platen 29 supports (a portion of) the rolled paper 2 positioned in the image recording region R on the transport path, and heats (the portion of) the rolled paper 2 (that is, the head unit 30 discharges the ink onto the heated rolled paper 2 which is supported by the platen 29). As shown in FIG. 1, the platen 29 is provided to correspond to the image recording region R on the transport path and arranged in a region along the transport path between the first transporting roller 23 and the second transporting roller 24. Then, by being supplied with heat generated by a heater unit 70, the platen 29 can heat the portion of the rolled paper 2.

The heater unit 70 is a unit to heat the rolled paper 2 and has a heater (not shown). The heater has a nichrome wire, and is configured to arrange the nichrome wire in the platen 29 so that the distance thereof from the support surface of the platen 29 is constant. For this reason, the nichrome wire is caused to emit heat through energization of the heater and the heat can be conducted to the portion of the rolled paper 2 positioned on the support surface of the platen 29. Since the heater is configured by embedding the nichrome wire in the entire platen 29, heat can be evenly conducted to the portion of the rolled paper 2 on the platen 29. In the embodiment, the portion of the rolled paper 2 is evenly heated such that the temperature of the portion of the rolled paper 2 on the platen is 45° C. In so doing, the ink which landed on the portion of the rolled paper 2 can be caused to dry.

The blowing unit 80 is a unit to blow air to the rolled paper 2 on the platen 29. The blowing unit 80 is provided with fans 81 and a motor (not shown) for rotating the fans 81. By rotation of the fans 81, air is blown to the rolled paper 2 on the platen 29 to dry the ink which landed on the rolled paper 2. As shown in FIG. 1, the plural fans 81 are provided within a closeable cover (not shown) which is provided to a main body. When the cover is closed, each of the fans 81 is positioned above the platen 29 so as to face the support surface of the platen 29 (the rolled paper 2 on the platen 29).

The winding unit 90 is a unit to wind up the rolled paper 2 (rolled paper on which an image is recorded) sent by the transport unit 20. This winding unit 90 has a relay roller 91 around which the rolled paper 2 sent from the delivery roller 27 is drawn from the upward left side and transported rightward and diagonally downward and a winding drive shaft 92 for winding up the rolled paper 2 sent from the rotatably supported relay roller 91.

The controller 60 is a control unit to perform control of the image recording apparatus 1. As shown in FIG. 2, the controller 60 has an interface section 61, a CPU 62, a memory 63, and a unit control circuit 64. The interface section 61 is a section to perform sending and receiving of data between the image recording apparatus 1 and a host computer 110 which is an external device. The CPU 62 is a calculation processing device to perform control of the entire image recording apparatus 1. The memory 63 ensures a region of the CPU 62 to store programs, a work region and the like. The CPU 62 controls each unit by the unit control circuit 64 in accordance with a program stored in the memory 63.

The detector group 50 is to monitor circumstances inside the image recording apparatus 1 and may be, for example, a rotary encoder attached to the sensor for slack detection, a transporting roller and used to control transporting of the rolled paper 2 or the like, a paper detection sensor for detecting the presence of the rolled paper 2 being transported, a linear encoder for detecting the position of the carriage 42 (or the head 31) in the transportation direction (left and right direction), a paper end position detection sensor for detecting a paper end (edge) position in the width direction of the rolled paper 2, a sub-tank sensor or the like, which will be described later.

Ink Refill Unit 35

Configuration Example of Ink Refill Unit 35

Figure 3:
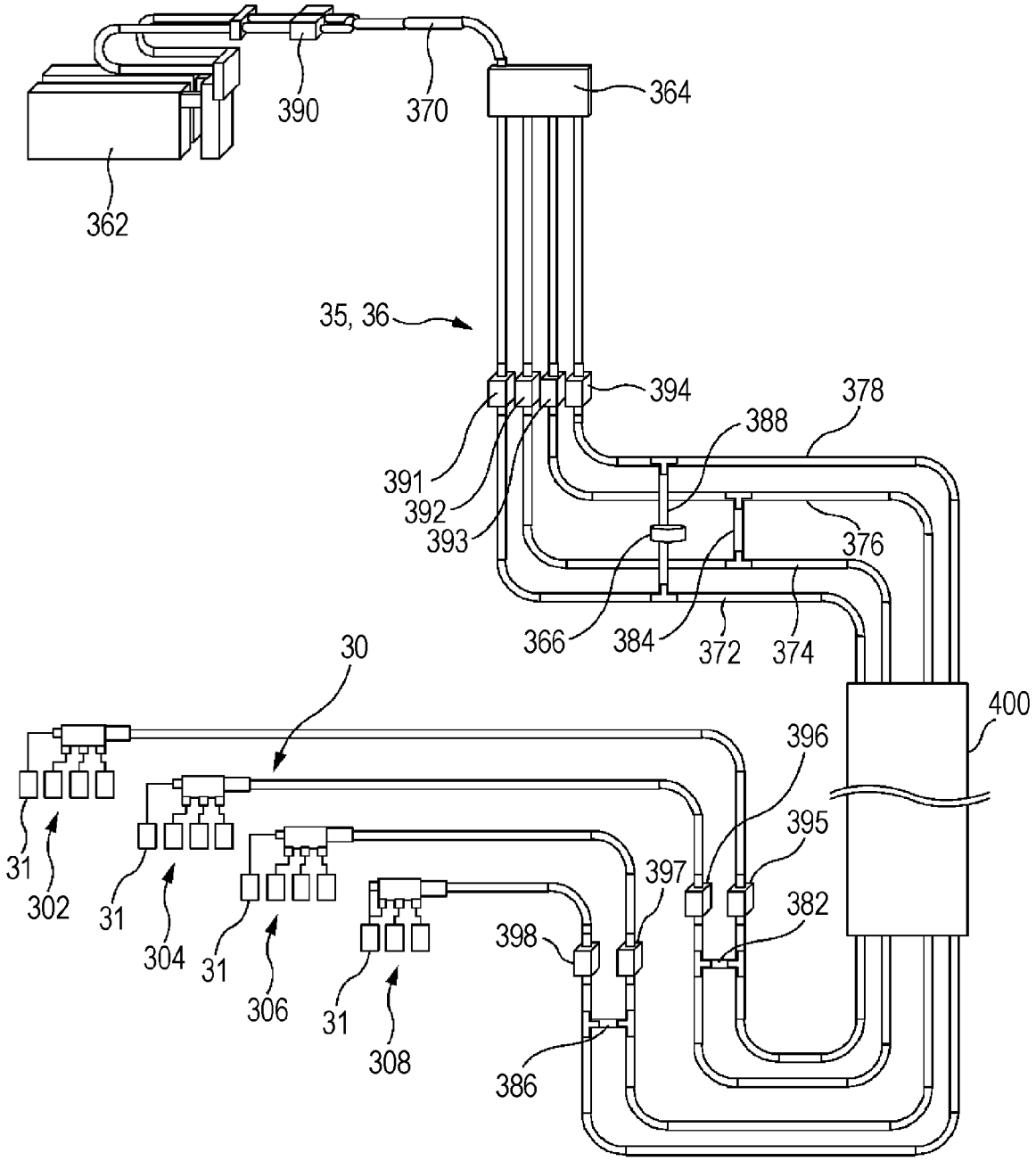
FIG. 3 is a schematic view of a white ink refill unit.
Figure 4:
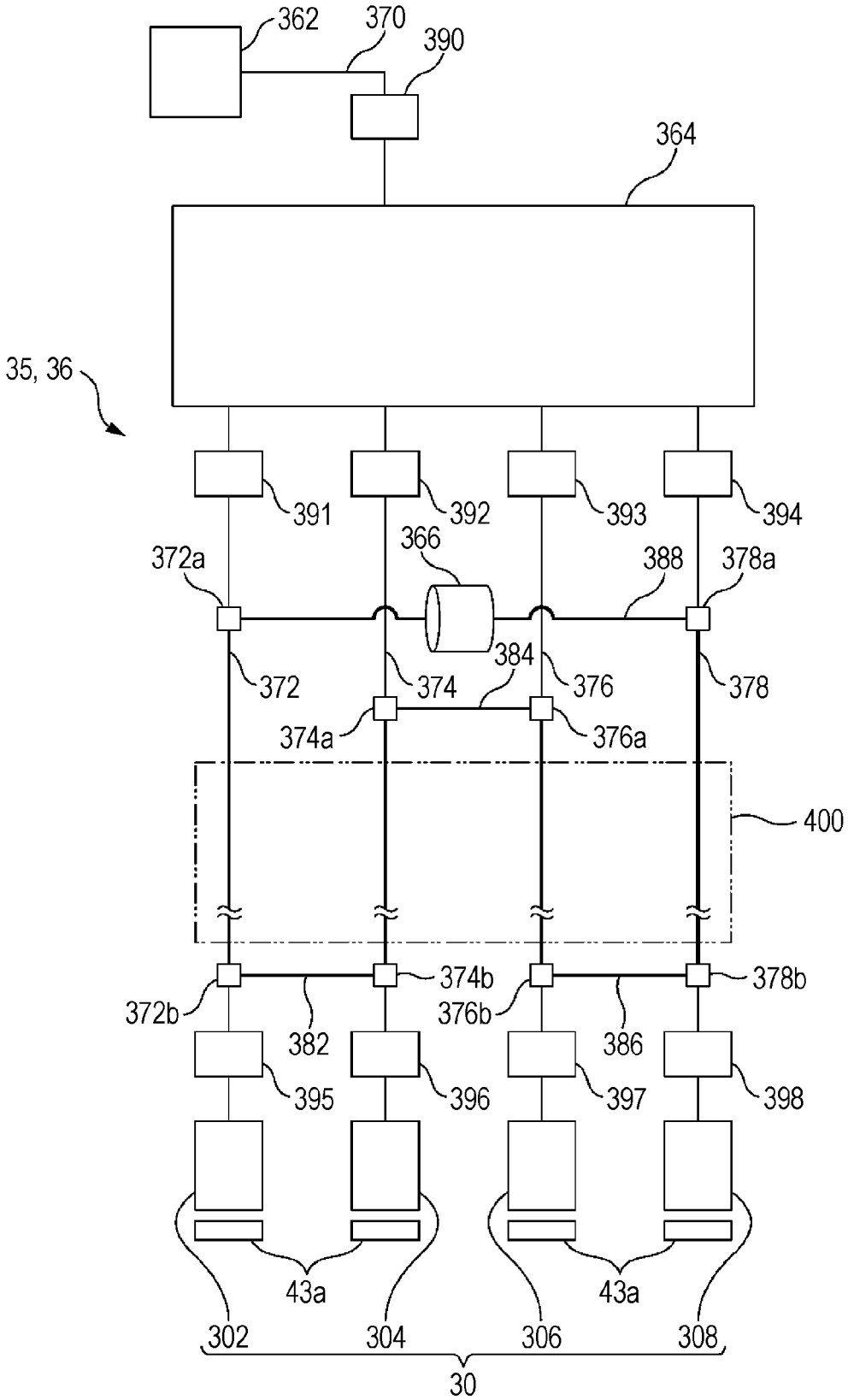
FIG. 4 is a block diagram of the white ink refill unit.

Next, the ink refill unit 35 will be described using FIGS. 1, 3 and 4. FIG. 3 is a schematic view of a white ink refill unit 36. FIG. 4 is a block diagram of the white ink refill unit 36. Further, FIG. 4 is shown in a block diagram state for easy view of FIG. 3 and FIGS. 3 and 4 show the same unit (the description will be made by using FIG. 4 for easy view).

As described above, the ink refill unit 35 is a unit to refill (supply) the head unit 30 with ink, when the amount of ink is reduced in the head unit 30 by discharging the ink from the head 31.

The ink refill unit 35 is provided in every ink type (ink color). That is, a yellow ink refill unit for yellow ink refill, a magenta ink refill unit for magenta ink refill, a cyan ink refill unit for cyan ink refill, a black ink refill unit for black ink refill, a white ink refill unit 36 for white ink refill and the like are provided.

Here, while the reason will be described later, the white ink refill unit 36 has a different configuration from the configurations of the ink refill units of other ink types (colors) except the white ink (on the other hand, the configurations of ink refill units of other ink types (colors) except the white ink are the same). Hereafter, the white ink refill unit 36 among the plural ink refill units 35 will be mainly described and only the differences between the configurations of the ink refill units of other ink types (colors) and the configuration of the white ink refill unit 36 will be described later.

A shown in FIG. 4, the white ink refill unit 36 has an ink cartridge 362, a sub-tank 364 which stores the white ink as an example of a storage unit, plural tubes which are flow paths (passages) of the white ink, plural valves (the vale is a solenoid valve in the embodiment; however there is no limitation thereto) for opening and closing the tubes and a pump 366 (the pump is a tube pump in the embodiment; however there is no limitation thereto). Further, the places where the ink cartridge 362 and the sub-tank 364 are installed are referenced by reference numbers 35 and 36 in FIG. 1.

The ink cartridge 362 accommodates the white ink to supply the ink to the head unit 30. The ink cartridge 362 is detachably provided with respect to the main body of the image recording apparatus.

Moreover, the ink cartridge 362 is connected to the sub-tank 364 through a tube which links between the ink cartridge 362 and the sub-tank 364 (the tube is referred to as a tube between IC and ST 370, for convenience) as shown in FIG. 4.

The sub-tank 364 temporarily stores the white ink supplied from the ink cartridge 362 to the head unit 30. The sub-tank 364 is fixed to the main body of the image recording apparatus. In other words, the sub-tank 364 is different from the ink cartridge 362 and not detachably provided with respect to the main body of the image recording apparatus.

In addition, the fact that the sub-tank 364 is connected to the ink cartridge 362 through the tube between IC and ST 370 has been already described. However, as shown in FIG. 4, a valve (the valve is referred to as a valve between IC and ST 390, for convenience) is provided in the tube between IC and ST 370. Moreover, when the amount of the white ink in the sub-tank 364 is less than a threshold value, a sub-tank sensor (not shown) which detects the content thereof is provided in the sub-tank 364.

Then, when the controller 60 receives the detection signal from the sub-tank sensor and grasps that the amount of the white ink in the sub-tank 364 is less than a threshold value, the closed valve between IC and ST 390 is opened to make the white ink flow from the ink cartridge 362 to the sub-tank 364. In this manner, the amount of the white ink is controlled such that the amount of the white ink of equal to or more than a threshold value usually remains (is stored) in the sub-tank 364.

In addition, as shown in FIG. 4, the sub-tank 364 is connected to the head unit 30 through four supply tubes which link between the sub-tank 364 and the head unit 30. The four supply tubes (first supply tube 372, second supply tube 374, third supply tube 376, and fourth supply tube 378) function as supply flow paths for supplying the white ink from the sub-tank 364 to the head unit 30.

In other words, when the white ink is discharged from the head unit 30 (heads 31) and the white ink in the head unit 30

(heads 31) is consumed by performing image recording (printing) and the like, the white ink in the sub-tank 364 flows into the head unit 30 (heads 31) through the first supply tube 372 to the fourth supply tube 378 so as to refill the cartridge with the consumed white ink.

As already described above, the head unit 30 according to the embodiment has the fifteen heads 31 and the fifteen heads 31 are provided with four head groups, that is, the first head group 302 to the fourth head group 308. However, each of the four supply tubes is connected to the each of the four head groups as shown in FIG. 4. In other words, each of the four supply tubes supplies the white ink to each of the corresponding head groups.

In other words, the first supply tube 372 is connected to the first head group 302 (first head to fourth head) and supplies the white ink to the first to the fourth heads. In addition, the second supply tube 374 is connected to the second head group 304 (fifth head to eighth head) and supplies the white ink to the fifth to the eighth heads. Moreover, the third supply tube 376 is connected to the third head group 306 (ninth head to twelfth head) and supplies the white ink to the ninth to the twelfth heads. Furthermore, the fourth supply tube 378 is connected to the fourth head group 308 (thirteenth head to fifteenth head) and supplies the white ink to the thirteenth to the fifteenth heads.

Further, as is clear from FIG. 1, the sub-tank 364 of the ink refill unit 35 is separated from the head unit 30. Therefore, each of from the first supply tube 372 to the fourth supply tube 378 is a very long tube and the length thereof is 5 to 6 meters. Further, as shown in FIG. 4, a cableveyor 400 is provided to spread the supply tubes from the first supply tube 372 to the fourth supply tube 378 and the supply tubes from the first supply tube 372 to the fourth supply tube 378 are accommodated in the cableveyor 400.

In addition, as shown in FIG. 4, a bypass tube is bridged between different supply tubes from each other. More specifically, four bypass tubes (first bypass tube 382 to fourth bypass tube 388) are provided and the first bypass tube 382 is bridged between the first supply tube 372 and the second supply tube 374, a second bypass tube 384 bridged between the second supply tube 374 and the third supply tube 376, a third bypass tube 386 is bridged between the third supply tube 376 and the fourth supply tube 378 and the fourth bypass tube 388 is bridged between the fourth supply tube 378 and the first supply tube 372.

Then, each of from the first bypass tube 382 to the fourth bypass tube 388 is different from each of from the first supply tube 372 to the fourth supply tube 378, is a very short tube and the length thereof is 5 to 20 cm.

In addition, as shown in FIG. 4, the second bypass tube 384 and the fourth bypass tube 388 are both positioned at a position close to the sub-tank 364 of the sub-tank 364 and the head unit 30 while the first bypass tube 382 and the third bypass tube 386 are both positioned at a position close to the head unit 30 of the sub-tank 364 and the head unit 30. In other words, the second bypass tube 384 and the fourth bypass tube 388 are provided between the cableveyor 400 and the sub-tank 364 outside of the cableveyor 400, and the first bypass tube 382 and the third bypass tube 386 are provided between the cableveyor 400 and the head unit 30 outside of the cableveyor 400.

Then, the bypass tubes are provided to circulate the white ink in a circulation flow path configured with the supply tubes and the bypass tubes in order to improve a defect that the components of the white ink are settled in the supply tubes when the white ink is accumulated.

In other words, by providing the bypass tubes, a closed flow path configured with the first supply tube 372, the first bypass tube 382, the second supply tube 374, the second bypass tube 384, the third supply tube 376, the third bypass tube 386, the fourth supply tube 378 and the fourth bypass tube 388 is formed (The closed flow path is indicated by a thick line in FIG. 4. Then, the thick line is thickly shown to indicate which part of FIG. 4 is the closed flow path for convenience and the thickness of the line is irrelevant to the thickness of the tube). In other words, the formed closed flow path is formed only with the supply tubes and the bypass tubes among the sub-tank 364, the head unit 30, the supply tubes and the bypass tubes.

Then, the pump 366 for making the white ink flow to the closed flow path is provided to a tube (the fourth bypass tube 388 in the embodiment; however, there is no limitation thereto), and when the pump 366 is operated, the closed flow path becomes the circulation flow path and the white ink is circulated in the circulation flow path (a defect of the settlement is improved by such circulation of the white ink).

Further, as shown in FIG. 4, two valves (sub-tank side valve and head unit side valve) are provided to each of the four supply tubes and thereby, a total of eight valves are provided to the supply tubes.

In other words, as the sub-tank side valve, a first sub-tank side valve 391 is provided between a first connecting unit 372*a* to which the fourth bypass tube 388 is connected and the sub-tank 364 with respect to the first supply tube 372, a second sub-tank side valve 392 is provided between a second connecting unit 374*a* to which second bypass tube 384 is connected and the sub-tank 364 with respect to the second supply tube 374, a third sub-tank side valve 393 is provided between a third connecting unit 376*a* to which the second bypass tube 384 is connected and the sub-tank 364 with respect to the third supply tube 376, and a fourth sub-tank side valve 394 is provided between a fourth connecting unit 378*a* to which the fourth bypass tube 388 is connected and the sub-tank 364 with respect to the fourth supply tube 378, respectively.

In addition, as the head unit side valve, a first head unit side valve 395 is provided between a fifth connecting unit 372*b* to which the first bypass tube 382 is connected and the head unit 30 with respect to the first supply tube 372, a second head unit side valve 396 is provided between a sixth connecting unit 374*b* to which the first bypass tube 382 is connected and the head unit 30 with respect to the second supply tube 374, a third head unit side valve 397 is provided between a seventh connecting unit 376*b* to which the third bypass tube 386 is connected and the head unit 30 with respect to the third supply tube 376 and a fourth head unit side valve 398 is provided between an eighth connecting unit 378*b* to which the third bypass tube 386 is connected and the head unit 30 with respect to the fourth supply tube 378, respectively.

Then, the reason that these sub-tank side valves and the head unit side valves are provided will be made apparent later.

Ink Circulation Process to Circulate White Ink

Figure 5:
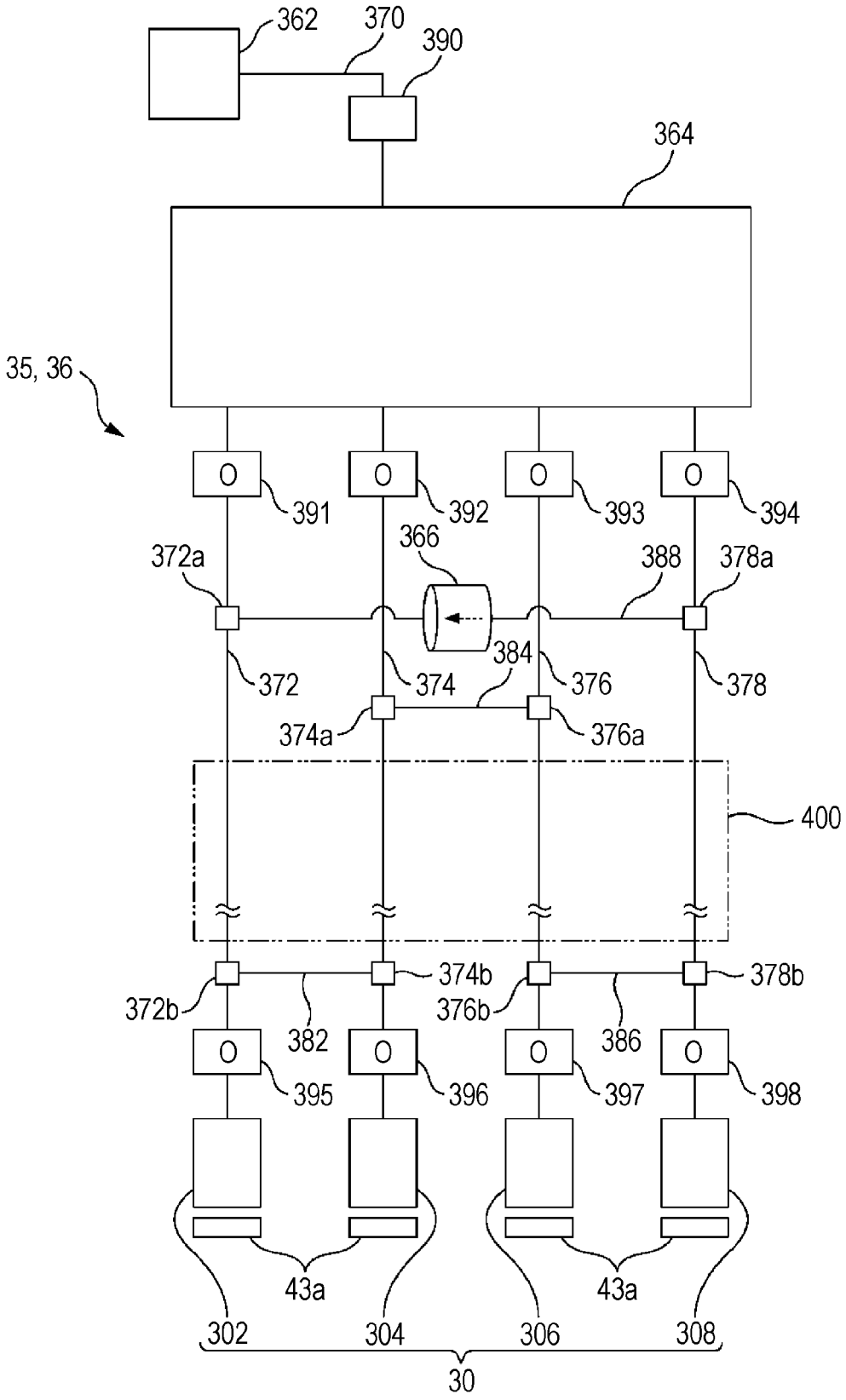
FIG. 5 is a block diagram showing the state of the white ink refill unit before an ink circulation process is performed.
Figure 6:
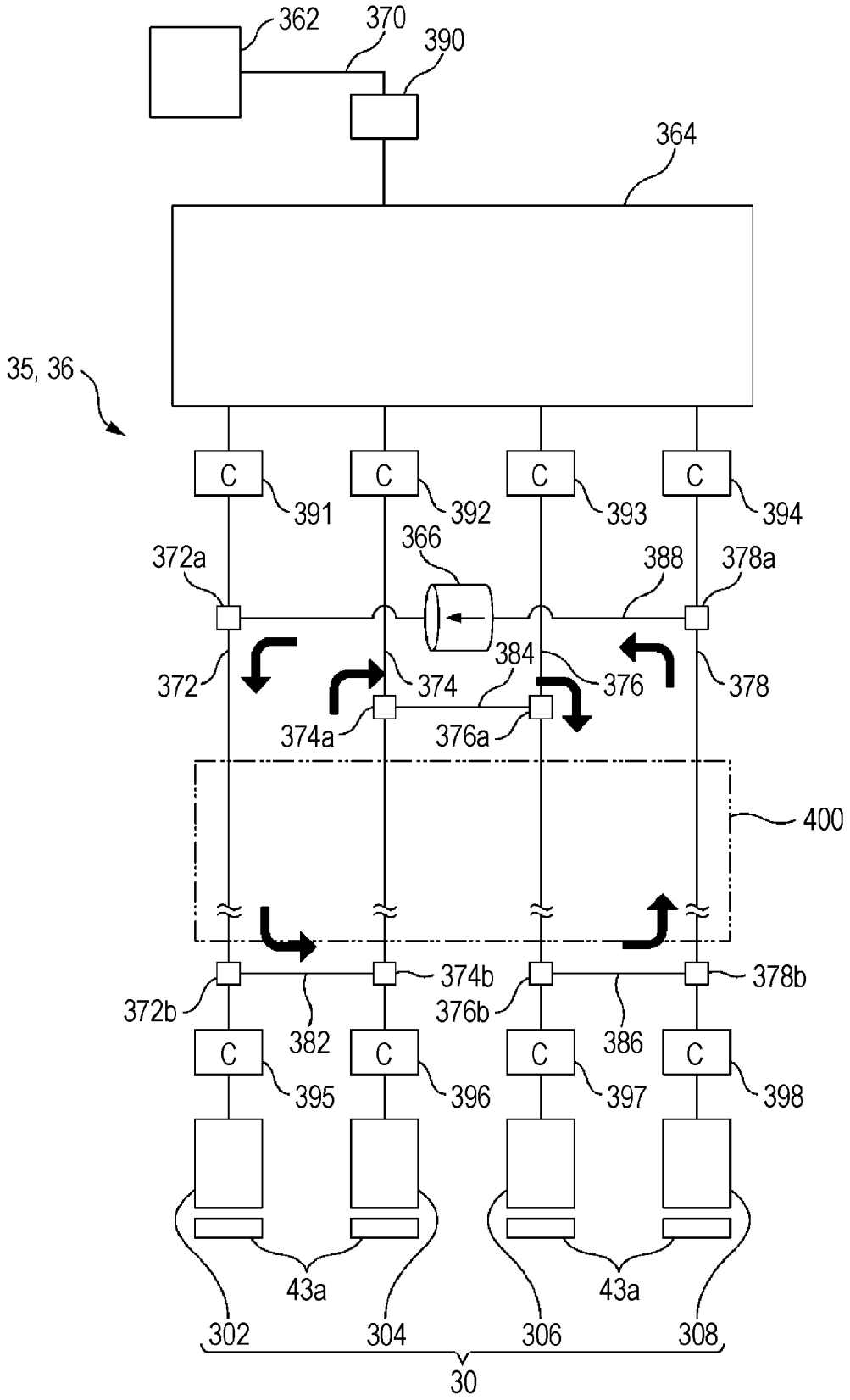
FIG. 6 is a block diagram showing the state of the white ink refill unit when the ink circulation process is performed.

Next, a process to circulate white ink in a circulation flow path (for convenience, referred to as an ink circulation process) will be described using FIGS. 5 and 6. FIG. 5 is a block diagram showing a state of the white ink refill unit 36 before an ink circulation process is performed. FIG. 6 is a block diagram showing a state of the white ink refill unit 36 when the ink circulation process is performed.

As described above, when the white ink is accumulated in the supply tubes (that is, from the first supply tube 372 to the fourth supply tube 378), a phenomenon (defect) that the components of the white ink are settled can occur. Further, when the phenomenon occurs, since the white ink in which the components are insufficient is discharged to the rolled paper 2, a problem of quality deterioration of an image is caused.

Then, the phenomenon is likely to occur when the image recording apparatus 1 is not used for a long time. Therefore, the ink circulation process is performed when the power is turned ON by setting.

FIG. 5 shows a state of the white ink refill unit 36 before an ink circulation process is performed, that is, a state of the white ink refill unit 36 just after the power is turned ON. At this time, as shown in FIG. 5, the sub-tank side valves and the head unit side valves are opened ("O" refers to "valve open"), and the pump 366 is not operated (a dotted arrow refers to "pump non-operation"). Then, when the power is turned OFF, since the image recording apparatus 1 is not used, the white ink in the supply tubes from the first supply tube 372 to the fourth supply tube 378 is accumulated and the components of the white ink are settled.

Then, in the state, the ink circulation process is performed by the controller 60. In other words, the controller 60 circulates the white ink in the circulation flow path configured with the supply tubes and the bypass tubes. Then, the controller 60 performs the followings to realize the process in the embodiment.

In other words, as shown in FIG. 6, the controller 60 operates the pump 366 (a solid arrow refers to "pump operation"). Then, the white ink is circulated in the circulation flow path by the operation and a defect that the components of the white ink are settled is improved. Therefore, quality deterioration of an image is suppressed.

Further, when the white ink is circulated in the circulation flow path, the controller 60 closes the valves from the first sub-tank side valve 391 to the fourth sub-tank side valve 394 ("C" refers to "valve closed") so as to perform the circulation without delay, or to completely remove a possibility of a bad influence from the movement of the white ink by the circulation on the sub-tank 364, as shown in FIG. 6.

In addition, in the same manner, the controller 60 closes the valves from the first head unit side valve 395 to the fourth head unit side valve 398 so as to perform the circulation without delay, or to completely remove a possibility of a bad influence from the movement of the white ink by the circulation on the head unit 30 as shown in FIG. 6.

Further, the purpose of the ink circulation process is to improve a phenomenon (defect) that the components of the ink are settled, which is already described. However, the phenomenon (defect) is likely to occur with respect to the white ink in comparison with other ink. That is, since a heavy substance such as titanium oxide is contained in the pigment components of the white ink, there is a tendency to remarkably settle the pigment components.

Therefore, in the embodiment, the ink circulation process is performed only on the white ink. However, the bypass tubes, the pump 366 and the head unit side valves are provided only in the white ink refill unit 36 not in the ink refill units 35 of other types (colors) (since the sub-tank side valves are necessary for other purpose, the sub-tank side valves are provided in the ink refill units 35 of other colors).

As described above, the image recording apparatus 1 according to the embodiment includes the sub-tank 364 which stores the white ink, the head unit 30 which discharges the ink onto the rolled paper 2, the plural supply tubes for supplying the white ink from the sub-tank 364 to the head unit 30, the plural bypass tubes bridged between different supply tubes from each other and the controller 60 which circulates the white ink in the circulation flow path formed only of the supply tubes and the bypass tubes among the sub-tank 364, the head unit 30, the supply tubes and the bypass tubes. Then, with the configuration, it is possible that the white ink flows to the supply tubes with a simple configuration.

In other words, as described above, the white ink in the supply tubes is accumulated and a phenomenon (defect) that the components of the white ink are settled occurs. Then, when the phenomenon occurs, since the white ink in which the components are insufficient is discharged to the rolled paper 2, a problem of quality deterioration of an image is caused.

Figure 7:
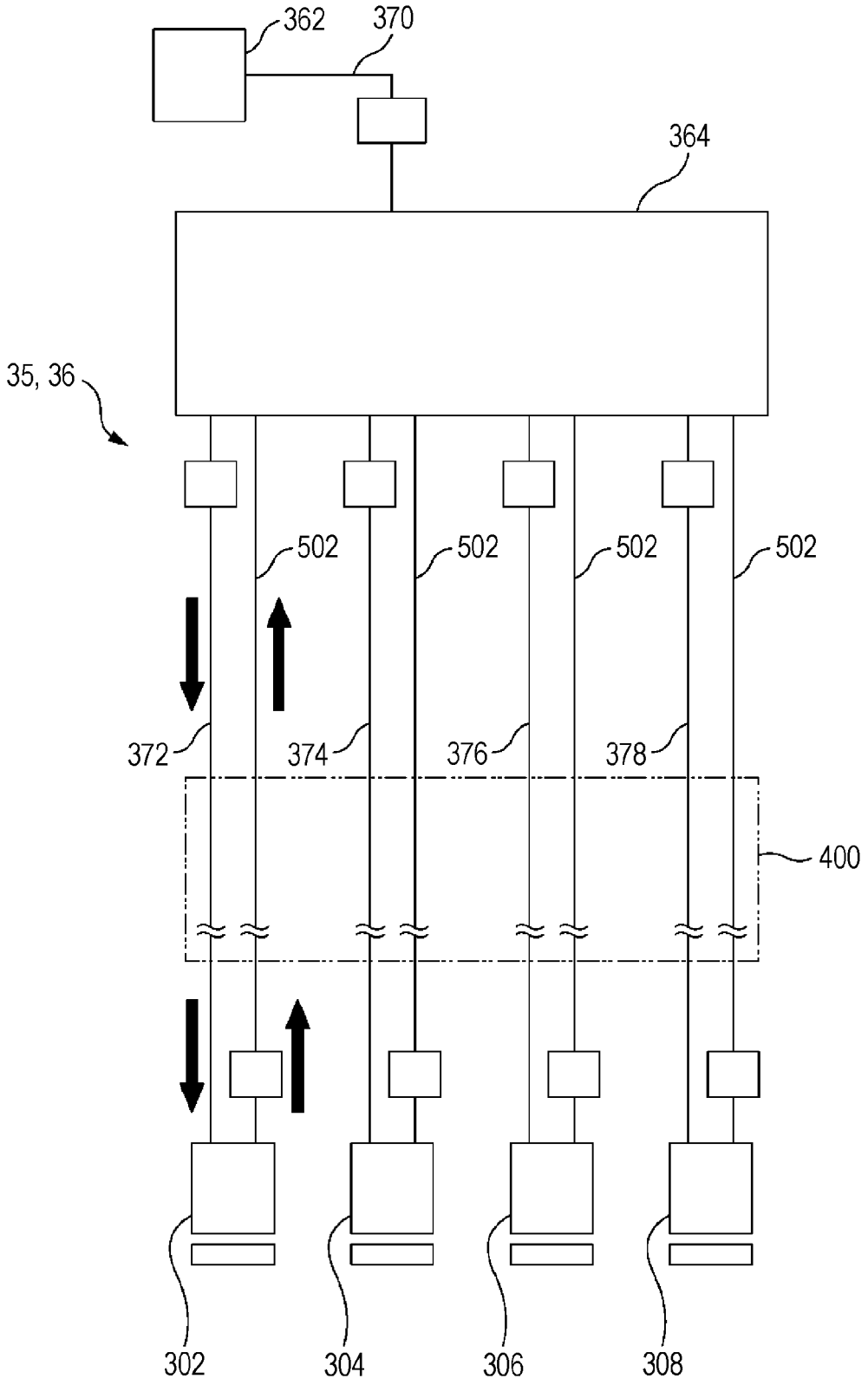
FIG. 7 is a block diagram of a white ink refill unit according to a comparative example.

In order to improve the phenomenon (defect), a method of making the white ink flow by circulating the white ink in the circulation flow path is adopted in the image recording apparatus 1 according to a comparative example as the embodiment. However, as shown in FIG. 7, a tube for return 502 for returning the white ink from the head unit 30 to the sub-tank 364 is provided to form a circulation flow path so that the white ink is circulated in the circulation flow path (refer to an arrow in FIG. 7) configured with the sub-tank 364, the supply tubes (for example, first supply tube 372), the head unit 30 and the tube for return 502 in the image recording apparatus 1 according to the comparative example.

Then, there are the following defects in this case. In other words, the tube for return 502 is necessary to connect the sub-tank 364 to the head unit 30 and the connection is not a simple operation. In addition, when the plural (for example, four) supply tubes are arranged, the tubes for return (for example, four tubes) corresponding to each of the supply tubes are prepared to connect tubes for return to the sub-tank 364 and the head unit 30 one by one (refer to FIG. 7). In this manner, the white ink refill unit 36 according to the comparative example does not have a simple configuration.

Conversely, as a result of a keen examination to simplify the configuration on in this application, the presence of plural supply tubes has been focused on and an idea that the supply tubes are linked to bypass tubes to form a circulation flow path has been obtained. In other words, the white ink is circulated in the circulation flow path formed only of the supply tubes and the bypass tubes among the sub-tank 364, the head unit 30, the supply tubes and the bypass tubes in the embodiment. Due to this, the circulation flow path can be formed without using the tube for return 502 which needs to connect the sub-tank 364 to the head unit 30, thereby simplifying the configuration. That is, it is possible to make the white ink in the supply tubes flow with a simple configuration according to the embodiment.

Performance Timing of Ink Circulation Process

In the above description, it is discussed that the white ink is accumulated in the supply tubes and the phenomenon that the components of the white ink are settled is likely to occur when the image recording apparatus 1 is not used for a long time and thereby, it is effective that the ink circulation process is performed when the power is turned ON. However, performance timing in which the performance of the ink circulation process is effective is not limited only to the case (there is other performance timing).

In the embodiment, the ink circulation process is also performed in other performance timing and which timing is the other performance timing here will be described using FIG. 8. Then, effectiveness when the ink circulation process is performed in other performance timing will be described in the next section.

Figure 8:
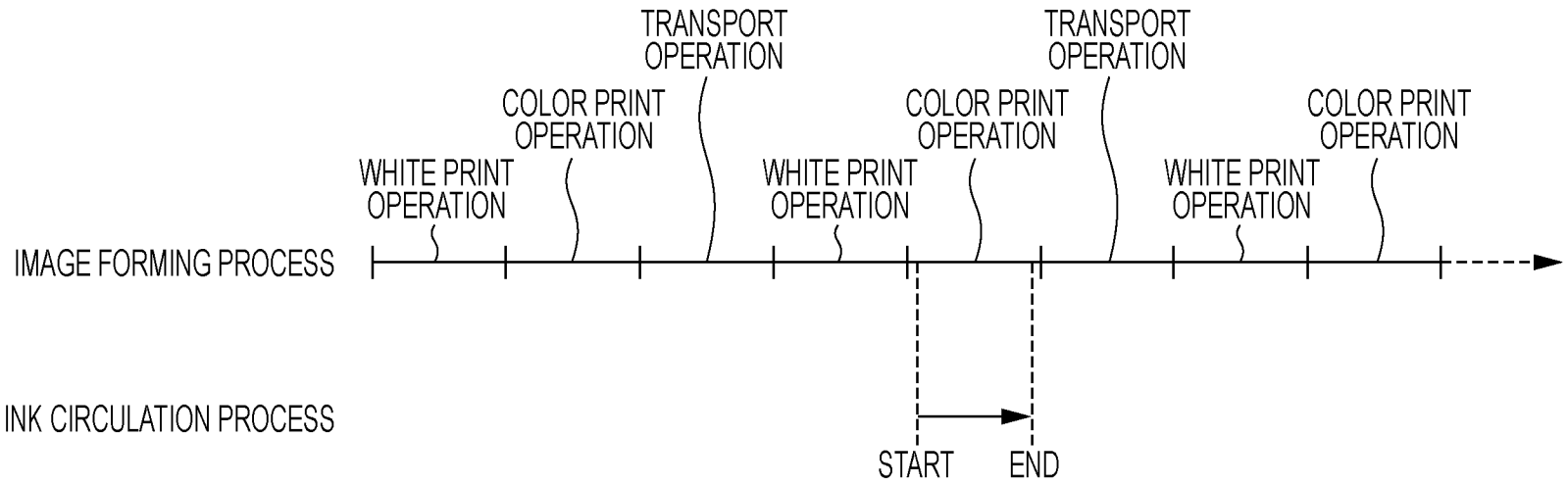
FIG. 8 is an illustration diagram to illustrate performance timing of an ink circulation process.

FIG. 8 is an illustration diagram to illustrate other performance timing.

First, an upper drawing of FIG. 8 is focused. The upper drawing shows the image forming process in time series (an arrow indicates a time axis). That is, as shown in the drawing, the controller 60 repeatedly performs the transport operation in which the above-described transport unit 20 is controlled to transport the rolled paper 2, the color print operation in which ink for color printing of the plural types of ink is discharged from the head unit 30 to perform color printing and the white print operation in which the white ink is discharged from the head unit 30 to perform printing (white printing) so that the image forming process which forms an image on the rolled paper 2 is performed. More specifically, the controller 60 according to the embodiment repeatedly performs a series of operations which is performed in order of the white print operation, the color print operation and the transport operation to perform the image forming process to from an image on the rolled paper 2 (Further, in the white print operation and the color print operation, the ink is discharged from the head unit 30 to land the ink on a portion of the rolled paper 2 positioned in the image recording region R in a state in which the rolled paper 2 is at a standstill (as described above, in a state in which the transportation is stopped)).

Then, as shown in a lower drawing of FIG. 8, when the controller 60 performs the color print operation, the ink circulation process is performed. Specifically, the ink circulation process is started after the white print operation ends and the ink circulation process ends before the transport operation is started in the embodiment.

In this manner, when the image recording apparatus 1 is being used, that is, the image forming process is being performed, the ink circulation process is performed in the embodiment unlike the above-described performance timing (when the power is turned ON).

Further, as shown in FIG. 8, the ink circulation process is performed in one color print operation of the repeatedly performed color print operation (plural color print operation) in the above description, which is merely an example and there is no limitation thereto. For example, the ink circulation process may be performed each time in the repeatedly performed color print operation (plural color print operation).

In addition, the color print does not exclude print containing a black image. However, the ink for color printing may include black (k) ink.

Effectiveness of Image Recording Apparatus 1 According to the Embodiment

As described above, the image recording apparatus 1 according to the embodiment includes the transport unit 20 which transports the rolled paper 2, the head unit 30 which discharges plural types of ink onto the rolled paper 2, the sub-tank 364 which stores the white ink among the plural types of ink, the plural supply tubes for supplying the white ink from the sub-tank 364 to the head unit 30, the plural bypass tubes which are bridged between different supply tubes from each other and the controller 60 which repeatedly performs the transport operation in which the transport unit 20 is controlled to transport the rolled paper 2, the color print operation in which the ink for color printing of the plural types of ink is discharged from the head unit 30 to perform color printing and the white print operation in which the white ink is discharged from the head unit 30 to perform white printing so that the image forming process which forms an image on the rolled paper 2 is performed and circulates the white ink in the circulation flow path which is formed only of the supply tubes and the bypass tubes among the sub-tank 364, the head unit 30, the supply tubes and the bypass tubes, when the color print operation is performed. With the configuration, it is possible to appropriately suppress quality deterioration of an image.

In other words, as described above, the white ink is accumulated in the supply tubes and a phenomenon (defect) that the components of the white ink are settled occurs. Then, when the phenomenon occurs, since the white ink in which the components are insufficient is discharged to the rolled paper 2, a problem of quality deterioration of an image is caused.

Further, since the phenomenon occurs when the image recording apparatus 1 is not used for a long time, the ink circulation process is performed at the timing of power being turned ON in the image recording apparatus 1 according to the comparative example.

However, in the image recording apparatus 1 according to the comparative example, the ink circulation process is not performed during the image forming process in which the image recording apparatus 1 is used. Then the inventors of this application have found the following problems when the ink circulation process is not performed at the timing.

In other words, there is a case where the white print operation in which some of plural head groups do not discharge the white ink during the white print operation in the image forming process is present. In other words, for example, as the head groups as described above, the head groups from the first head group 302 to the fourth head group 308 are provided. However, in spite of the white print operation performance, there can be a case where the white ink is not discharged from the fourth head group 308 at all. As a specific example of the case, a case where an image corresponding to the fourth head group 308 (an image to be formed by discharging the white ink from the fourth head group 308) itself is not present can be exemplified. In addition, since the rolled paper 2 with the narrow width is used, there is a case where the rolled paper 2 is not present in a position corresponding to the fourth head group 308 (a position to form an image by discharging the white ink from the fourth head group 308).

In this case, while the white ink is consumed from the first head group 302 to the third head group 306 in the white print operation, the white ink is not consumed from the fourth head group 308. Therefore, the white ink flows from the first supply tube 372 to the third supply tube 376 and the white ink is accumulated in the fourth supply tube 378 so that a phenomenon that the components of the white ink are settled occurs.

Furthermore, when the white print operation in which some of the head groups (for example, the fourth head group 308) do not discharge the white ink is repeatedly performed in the image forming process, a phenomenon that the components of the white ink are settled in the fourth supply tube 378 is further developed.

Conversely, as shown in FIG. 8, when the color print operation is performed in the embodiment, since the ink circulation process is set to be performed, the white ink appropriately flows in the in the fourth supply tube 378 by circulating the white ink in the circulation flow path. For this reason, a problem that the components of the white ink are settled when the white ink is accumulated in the fourth supply tube 378 is solved to appropriately suppress quality deterioration of an image.

In addition, the platen 29 which supports and heats the rolled paper 2 is provided, the head unit 30 discharges the white ink onto the heated rolled paper 2 which is supported by the platen 29 in the embodiment. Therefore, the head unit 30 is positioned around the platen 29 so that the white ink in the supply tubes connected to the head unit 30 is affected by the heat from the platen 29.

In the circumstance, the white ink is accumulated in the fourth supply tube 378 and the following problem (hereinafter, referred to as a viscosity difference problem, for convenience) may occur as well as the above-described problem that the components of the white ink are settled (hereinafter, for convenience, referred to as a settling problem. Refer to below). In other words, since the white ink is accumulated in the fourth supply tube 378, the temperature of the white ink is higher than the temperature of the white ink which flows from the first supply tube 372 to the third supply tube 376. Then, the viscosity difference occurs between the white ink in the fourth supply tube 378 and the white ink in the first supply tube 372 to the third supply tube 376 (the viscosity of the white ink in the fourth supply tube 378 is smaller than the viscosity of the white ink in the first supply tube 372 to the third supply tube 376 in the embodiment). Therefore, there is viscosity difference between the white ink discharged from the first head group 302 to the third head group 306 and the white ink discharged from the fourth head group 308 to cause image quality difference between an image by the white ink discharged from the first head group 302 to the third head group 306 and an image by the white ink discharged from the fourth head group 308.

Accordingly, when a so-called heating platen is provided (in the case of the image recording apparatus 1 according to the embodiment), the controller 60 performs the ink circulation process during the color print operation to solve the viscosity difference problem as well as the settling problem. Therefore, the above-described effect, that is, the effect of suppressing quality deterioration of an image is more effectively exhibited.

Other Embodiments

While the embodiment has mainly set forth a printing apparatus, the Specification includes disclosure of method of circulating white ink and the like. The embodiment is intended merely to aid in understanding the invention, and should not be construed as limiting the invention. Modifications and improvements to the invention may be made without departing from the spirit thereof, and such equivalents will naturally be included within the scope of the invention. In particular, the embodiments mentioned below are included within the scope of the invention.

In the above-described embodiment, the rolled paper 2 is described as an example of a medium but there is no limitation thereto. For example, cut paper, a film and fabric may be used.

In addition, the sub-tank 364 is described as an example of a storage unit in the above-described embodiment but there is no limitation thereto. For example, the ink cartridge 362 may be connected to the head unit 30 through the supply tube without the sub-tank 364 (in this case, the ink cartridge 362 corresponds to the storage unit).

Furthermore, the head group is used as a sub-head unit in the above-described embodiment but there is no limitation thereto. A single head may be used.

Figure 9:
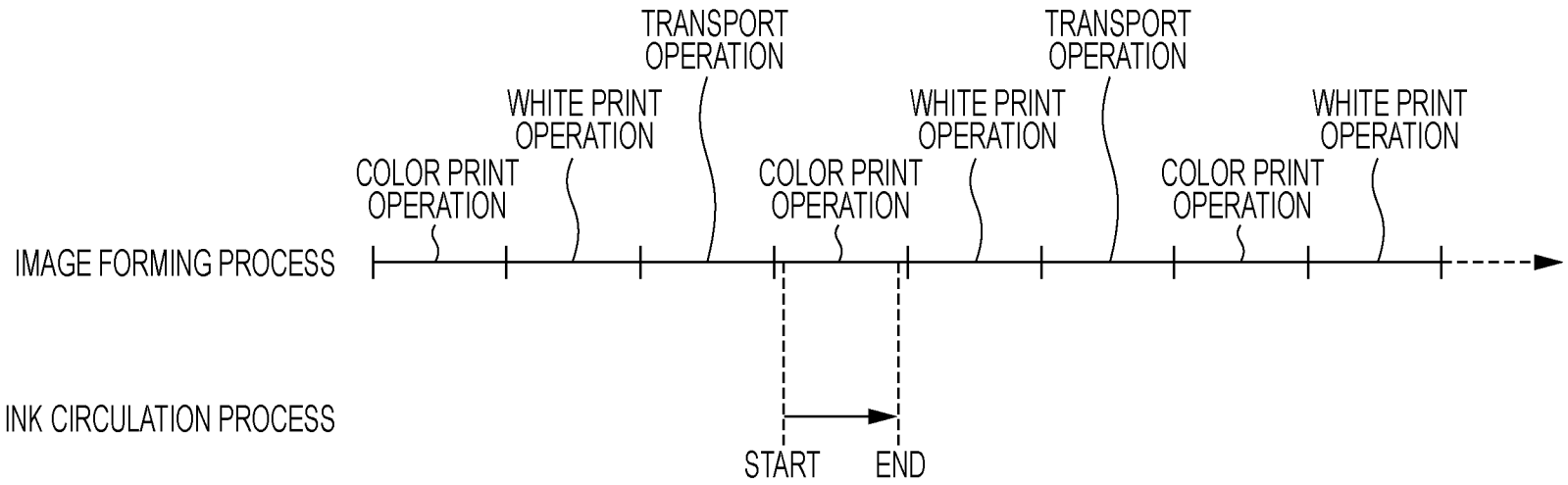
FIG. 9 is an illustration diagram to illustrate performance timing of an ink circulation process according to a first modification example.

Furthermore, the controller 60 repeatedly performs a series of operations in order of the white print operation, the color print operation and the transport operation to perform the image forming process which forms an image on the rolled paper 2 in the above-described embodiment. However, there is no limitation to the order of the series of operations. For example, as shown in FIG. 9, the controller may repeatedly perform a series of operations in order of the color print operation, the white print operation and the transport operation to perform the image forming process which forms an image on the rolled paper 2.

Figure 10:
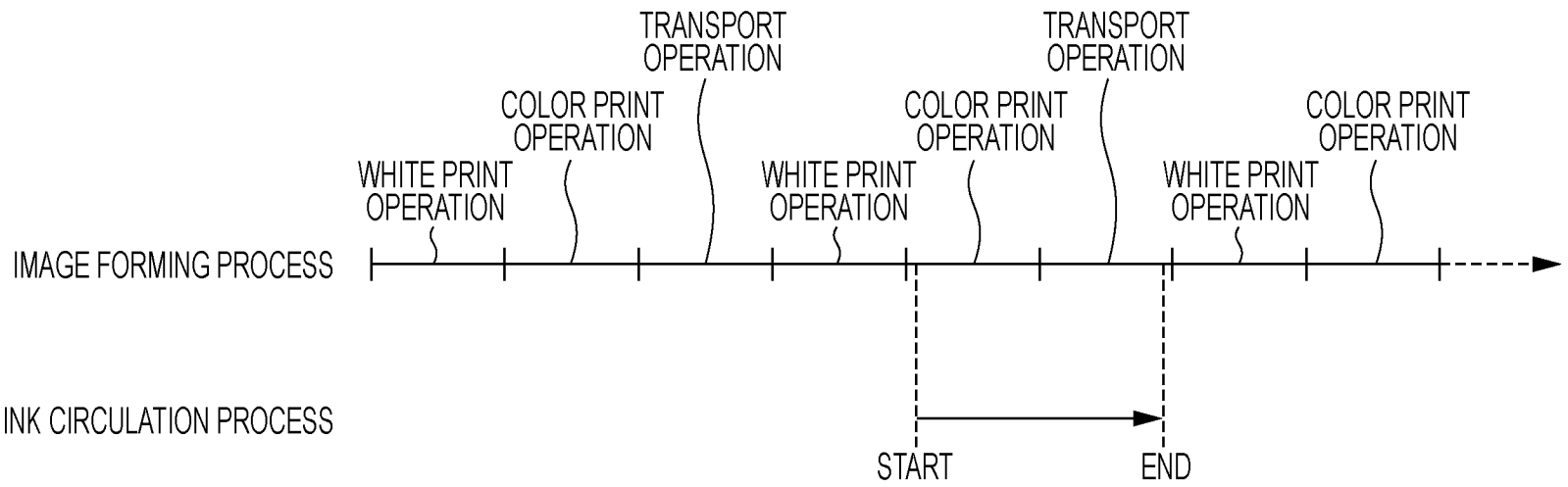
FIG. 10 is an illustration diagram to illustrate performance timing of an ink circulation process according to a second modification example.

Furthermore, the controller 60 repeatedly performs a series of operations in order of the white print operation, the color print operation and the transport operation to perform the image forming process which forms an image on the rolled paper 2 so that the ink circulation process ends before the transport operation is started in the above-described embodiment but there is no limitation thereto. As shown in FIG. 10, the ink circulation process may end after the transport operation is started and before the white print operation ends.

However, the example according to the embodiment has an advantage in the following point in comparison with an example of FIG. 10. That is, since a period from the ink circulation process end to the white print operation start is short in the example of FIG. 10, there may be a possibility of not taking the sufficient time when the circulated white ink is statically determinated before the white print operation is performed (settlement time).

Meanwhile, since a period of performing the transport operation can be used as time when the circulated white ink is statically determinated before the white print operation is performed (settlement time) in order to end the ink circulation process before the transport operation is started, the white print operation is reliably performed with the statically determinated white ink in the embodiment.

On the contrary, the example of FIG. 10 has an advantage in that when the ink circulation process in the color print operation period is not sufficient, an additional ink circulation process period can be ensured in comparison with the example according to the embodiment.

In addition, the controller 60 may determine whether there is the white print operation in which some of plural head groups do not discharge the white ink (for example, as described above, the white print operation in which the fourth head group 308 of the first head group 302 to the fourth head group 308 does not discharge the white ink) and then, may determine whether the white ink is circulated in the circulation flow path on the basis of the determination result.

In other words, the controller 60 determines whether there is the white print operation in which a part (for example, the fourth head group 308) of the head groups does not discharge the white ink by analyzing contents of a print data and various commands included in a print data (it is possible to grasp a case where an image corresponding to the fourth head group 308 is not present or a case where the rolled paper 2 is not present at a position corresponding to the fourth head group 308 through the analysis), when the print date is received from the host computer 110.

Then, the controller 60 determines whether to perform the ink circulation process on the basis of the determination result. In other words, when it is determined that "there is the white print operation", the ink circulation process is performed during the image forming process to solve a problem that the components of the white ink are settled when the white ink is accumulated in the fourth supply tube 378, for example, as shown in FIG. 8. Meanwhile, when it is determined that "there is no white print operation", since a problem that the components of the white ink are settled when the white ink is accumulated in the fourth supply tube 378 does not occur, the ink circulation process is not performed during the image forming process.

Due to this, since the ink circulation process is performed only as necessary, an effective process can be realized (moreover, it is advantageous from the viewpoint of power consumption for operating the pump 366, the sub-tank side valves, the head unit side valves and aged deterioration thereof).

Meanwhile, when such determination is omitted and the ink circulation process is performed during the image forming process, superiority is obtained from the viewpoint of easy control.

What is claimed is:

1. A printing apparatus comprising:

a transporting unit which transports a medium;

a head unit which discharges a plurality of types of ink onto the medium;

a storage unit which stores white ink of the plurality of types of ink;

a plurality of supply flow paths for supplying the white ink from the storage unit to the head unit;

a plurality of bypass flow paths which are bridged between different supply flow paths from each other, wherein the plurality of bypass flow channels include at least a first and second bypass channels that connect different supply flow channels of the plurality of supply flow channels; and a controller, the controller configured to repeatedly perform:

a transport operation in which the transporting unit is controlled to transport the medium;

a color print operation in which the head unit is controlled to discharge ink for color printing of the plurality of types of ink onto the medium; and a white print operation in which the head unit is controlled to discharge white ink of the plurality of types of ink onto the medium, wherein the white ink is circulated in a closed-loop circulation flow path when the color print operation is performed, the closed-loop circulation flow path being formed by the supply flow paths and bypass flow paths only, such that when circulating in the closed-loop circulating flow path, the white ink substantially only circulates in the supply paths and the bypass paths.

2. The printing apparatus according to claim 1, wherein the controller repeatedly performs a series of operations performed in order of the white print operation, the color print operation and the transport operation to perform the image forming process so that a circulation process to circulate the white ink in the circulation flow path ends before the transport operation is started.

3. The printing apparatus according to claim 1, wherein the head unit is made up of a plurality of sub-head units, each of the plurality of supply flow paths supplies the white ink to each of the corresponding sub-head units, and the controller determines whether there is the white print operation in which some of the plurality of sub-head units do not discharge the white ink and then, determines whether the white ink is circulated in the circulation flow path on the basis of the determination result.

4. The printing apparatus according to claim 1, further comprising a platen which supports and heats the medium, wherein the head unit discharges the white ink onto the heated medium which is supported by the platen.

5. A method of circulating white ink comprising:

repeatedly performing:

a transport operation in which a transporting unit is controlled to transport the medium;

a color print operation in which a head unit is controlled to discharge ink for color printing onto the medium; and a white print operation in which the head unit is controlled to discharge white ink onto the medium;

and circulating the white ink in a closed-loop circulation flow path when the color print operation is performed, the closed-loop circulation flow path being formed by only supply flow paths which supply the white ink to the head unit from a storage unit and a plurality of bypass flow paths which are bridged between different supply flow paths, such that when circulating in the closed-loop circulating flow path, the white ink substantially only circulates in the supply paths and the bypass paths, wherein the plurality of bypass flow channels include at least a first and second bypass channels that connect different supply flow channels of the plurality of supply flow channels.

* * * * *